US007665241B2

(12) United States Patent
Oz

(10) Patent No.: US 7,665,241 B2
(45) Date of Patent: Feb. 23, 2010

(54) FIREARM HANDGRIP WITH A HORIZONTAL ANGLE TRACKING BIPOD

(76) Inventor: Eldad Oz, Command Arms Accessories, 76 Vincent Cir., Ivyland, PA (US) 18974

( * ) Notice: Subject to any disclaimer, the term of this patent is extended or adjusted under 35 U.S.C. 154(b) by 0 days.

(21) Appl. No.: 12/217,693

(22) Filed: Jul. 8, 2008

(65) Prior Publication Data

US 2009/0056192 A1 Mar. 5, 2009

Related U.S. Application Data

(60) Provisional application No. 60/959,105, filed on Jul. 11, 2007.

(51) Int. Cl.
*F41A 23/10* (2006.01)

(52) U.S. Cl. ..... 42/94; 89/37.04; 89/40.06

(58) Field of Classification Search ..... 42/94; 89/37.04, 37.07, 40.06
See application file for complete search history.

(56) References Cited

U.S. PATENT DOCUMENTS

| | | | | |
|---|---|---|---|---|
| 271,251 | A | 1/1883 | Leerbech et al. | |
| 575,529 | A | 1/1897 | Stephens | 280/300 |
| 721,425 | A | 2/1903 | Clyde | 248/170 |
| 1,295,688 | A | 2/1919 | Butler | |
| 1,355,660 | A | 10/1920 | Farquhar et al. | |
| 1,382,406 | A | 6/1921 | Butler | |
| 1,580,406 | A | 4/1926 | Browning | |
| 2,386,802 | A | 10/1945 | Johnson | |
| 2,420,267 | A | 5/1947 | Sefried | |
| 2,436,349 | A | 2/1948 | Adams | |
| 2,489,283 | A | 1/1949 | Garand | 42/94 |
| 2,763,456 | A | 9/1956 | Breer | 248/186.1 |
| 3,235,997 | A | 2/1966 | Stoner | |
| 3,632,073 | A | 1/1972 | Nakatani | 248/169 |
| 4,121,799 | A | 10/1978 | Michio | 248/171 |
| 4,545,660 | A | 10/1985 | Rudolf | 396/425 |
| 5,345,706 | A | 9/1994 | Brown | 42/94 |
| 5,384,609 | A | 1/1995 | Ogawa et al. | 396/419 |
| 5,438,786 | A | 8/1995 | Hilderbrand | 42/94 |
| 5,711,103 | A | 1/1998 | Keng | 42/94 |
| 6,289,622 | B1 | 9/2001 | Desch et al. | 42/94 |
| 6,487,807 | B1 | 12/2002 | Kopman et al. | |
| 7,111,424 | B1 | 9/2006 | Moody et al. | 42/72 |
| 2005/0241206 | A1 | 11/2005 | Teetzel et al. | 42/72 |
| 2008/0052979 | A1 * | 3/2008 | Lee et al. | 42/94 |

* cited by examiner

*Primary Examiner*—Stephen M Johnson
(74) *Attorney, Agent, or Firm*—Martin Fleit; Paul D. Bianco; Fleit Gibbons Gutman Bongini & Bianco PL

(57) ABSTRACT

A firearm handgrip includes a housing and a bipod movable between stored and deployed positions. The bipod is adapted for panning (horizontal rotation), tilting (up-down) and canting (right-left) movements when deployed and includes a torsion spring enabling tracking a horizontal angle for quick leg realignment. The bipod includes a piston, a deployment spring between the piston and the housing, and a locking assembly for holding the bipod in the stored position. The locking mechanism preferably first and second magnet pieces respectively located on a release ram near the top of the housing and on the piston. Alignment between the magnet pieces in a first ram position holds the bipod in the stored position while movement to a second ram position creates magnet misalignment for bipod release.

2 Claims, 5 Drawing Sheets

FIREARM HANDGRIP WITH A HORIZONTAL ANGLE TRACKING BIPOD

CROSS-REFERENCE TO RELATED APPLICATION

This application claims priority from U.S. provisional application No. 60/959,105, filed Jul. 11, 2007.

FIELD OF THE INVENTION

The present invention relates generally to firearm accessories and more particularly to a firearm vertical handgrip with a bipod.

BACKGROUND OF THE INVENTION

Shooting a firearm with precision accuracy, particularly during combat, requires a steady and stable rifle support. Stabilizing the rifle manually, relying solely on body support, is difficult for the degree of stability needed for long range or small target accuracy. Therefore, mechanical support devices are used as a means for stabilizing the weapon and improving accuracy.

Stabilizing devices include various slings, shooting sticks, bipods and tripods. In recent times, compact collapsible and/or extendable bipods have been developed. Collapsible bipods are relatively lightweight and are mountable to the forearm stock or mounting rail of a firearm. These bipods include a pair of legs that can be pivoted from a tucked position adjacent the firearm stock to a down position to support the barrel on a support surface. Extendable bipods allow the length of the legs to be extended.

Tracking a moving target typically requires several different motions of the firearm. One motion is a horizontal or lateral rotation, also referred to as "panning." Another motion is the vertical rotation of the firearm, also referred to as "tilting." A third motion is sometimes required if the bipod legs are on an uneven support surface, requiring the firearm to be rotated on the support axis in order to stay vertically aligned with the gravity force. This motion is referred to as "canting."

Bipods have been made that are retractable within a housing that also serves as a forward handgrip. For example, U.S. Pat. No. 7,111,424 (Moody et al) discloses a fore end handgrip in the form of a tubular housing that holds a concealable bipod. The bipod legs deploy from the handgrip and lock in the extended position when a latch releases a spring. However, the locked bipod then restricts the above-mentioned motions (panning, tilting, and canting).

U.S. Pat. Publication No. 2005/0241206 (Teetzel et al.) discloses a similar hollow fore end grip with a retractable bipod. The bipod grip allows horizontal planning, and provides stop members to limit the degree of horizontal panning of the weapon relative to the bipod leg. The relative rotation permits the weapon to be horizontally pivoted to engage the target without the need to move or shift the bipod feet relative to the underlying support surface, but when the weapon is lifted there is no restoring force to return the bipod legs to alignment with the bore of the weapon.

Sometimes it is required to pan along the path of a moving target. If the target stops and allows time to obtain a good sight picture, it would be an advantage to be able to lift the weapon to take the weight off of the bipod legs and have the legs automatically return to alignment with the bore while achieving a precise sight picture prior to making the shot. It would be advantageous, therefore, to have a quick-deployment bipod that tracks the horizontal rotation angle of the firearm and enables a quick realignment of the bipod.

It would also be an advantage to have a release mechanism for the bipod release that is reliable and difficult to jam with dirt or debris.

SUMMARY OF THE INVENTION

The present invention discloses a firearm handgrip with a collapsible bipod that is retractable within a vertical handgrip. Specifically, the bipod is quickly deployed by pressing a button that activates a release mechanism. The shooter can place the deployed bipod on any surface, including uneven surfaces wherein the bipod legs are positioned on different heights. The bipod allows panning (horizontal rotation), tilting (up-down) and canting (right-left) motions of the firearm. Additionally, after panning the rifle and then lifting the bipod from the surface it lies on, the bipod's legs automatically realign to a plane perpendicular to the firearm. Thus, the bipod tracks and adjusts to the new position of the firearm.

The handgrip comprises four main elements. The first element is a hollow housing that can be mounted to an accessory rail on a firearm. The housing may be made from aluminum, hardened polymer, composite material and the like. The second element is a bipod that enables panning, tilting and canting motions and further enables tracking a horizontal angle for quick realignment of the bipod legs. The third element is a compression spring that forces the bipod to deploy. The fourth element is a release mechanism for releasing the compression spring to deploy the bipod. The release mechanism includes aligned magnetic pieces. When the release ram is moved, the magnets are moved out of alignment to allow the compression spring to deploy the bipod.

The magnet release is reliable and difficult to jam. While dirt or debris can jam a mechanical release button from moving, the magnetic force can be manually overcome by simply pulling on the bipod feet, even if the ram is stuck.

BRIEF DESCRIPTION OF THE DRAWINGS

The subject matter regarded as the invention will become more clearly understood in light of the ensuing description of embodiments herein, given by way of example and for purposes of illustrative discussion of the present invention only, with reference to the accompanying drawings.

FIG. 4A shows the bipod of the handgrip in a stored and locked position. FIG. 4B illustrates the depressed position for a release mechanism of the firearm handgrip that provides for the deployment of the bipod. FIG. 4C shows the bipod in the deployed position.

DETAILED DESCRIPTION OF THE DRAWINGS

Figure 1:
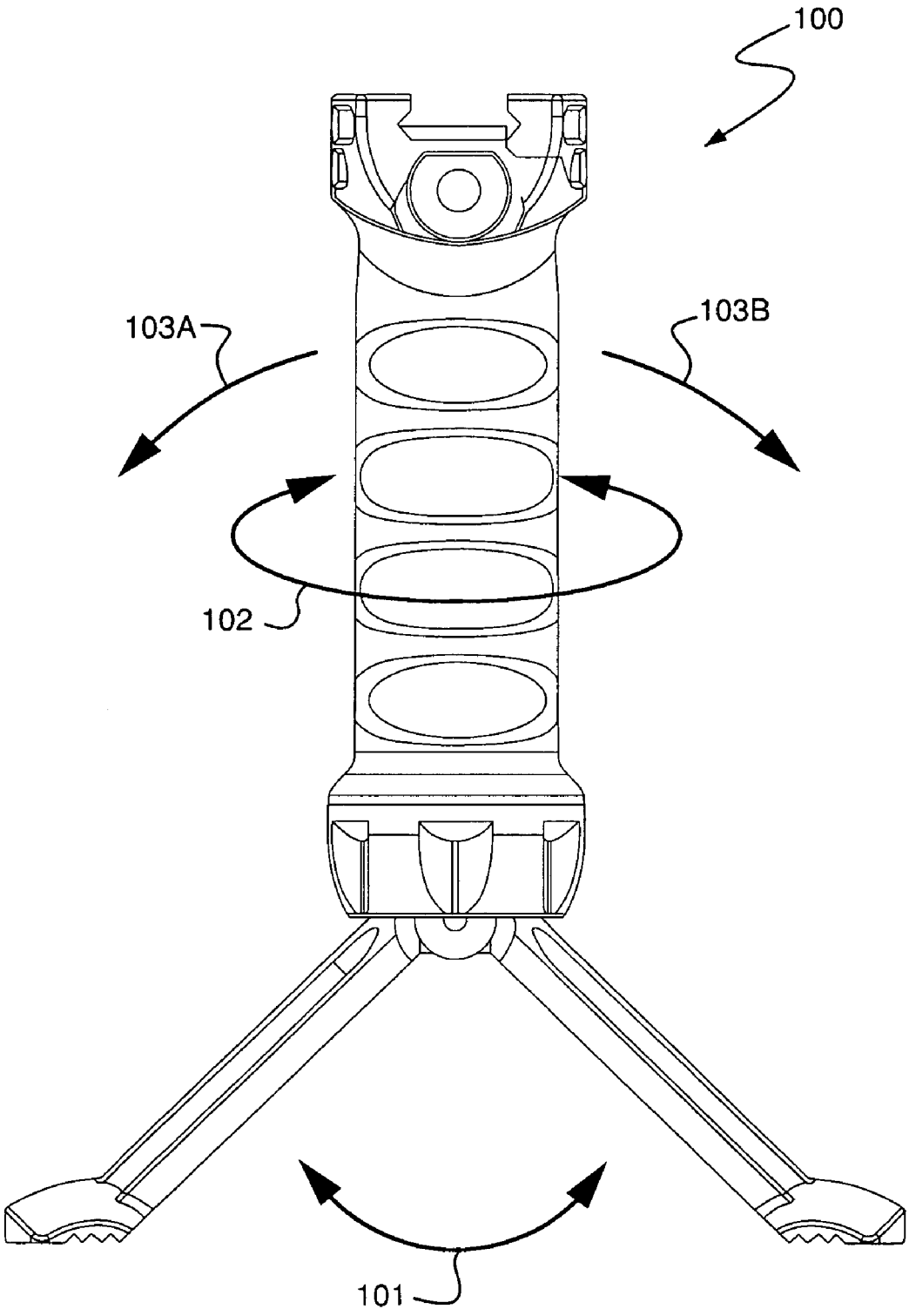
FIG. 1 is an elevational view of a firearm handgrip according to an exemplary embodiment of the invention showing the bipod of the firearm handgrip in a deployed position.

Referring to the drawings where like reference numbers refer to like elements, there is shown in the elevational view of FIG. 1 a firearm handgrip 100 with retractable bipod according to an exemplary embodiment of the invention, with the bipod 101 deployed. The handgrip 100 enables the shooter to move the firearm in all three planes relative to the bipod. Specifically, the handgrip 100 may be horizontally rotated around it's vertical axis in a panning motion 102. The handgrip may be tilted vertically (into and outwards from the drawing) for an elevation adjustment of the sight picture. Finally, the handgrip 100 may be canted to the left 103A and to the right 103B (i.e., rotated about the axis of the bore) in order to keep the sights vertically aligned when the bipod is placed onto a non-level support surface.

Figure 2:
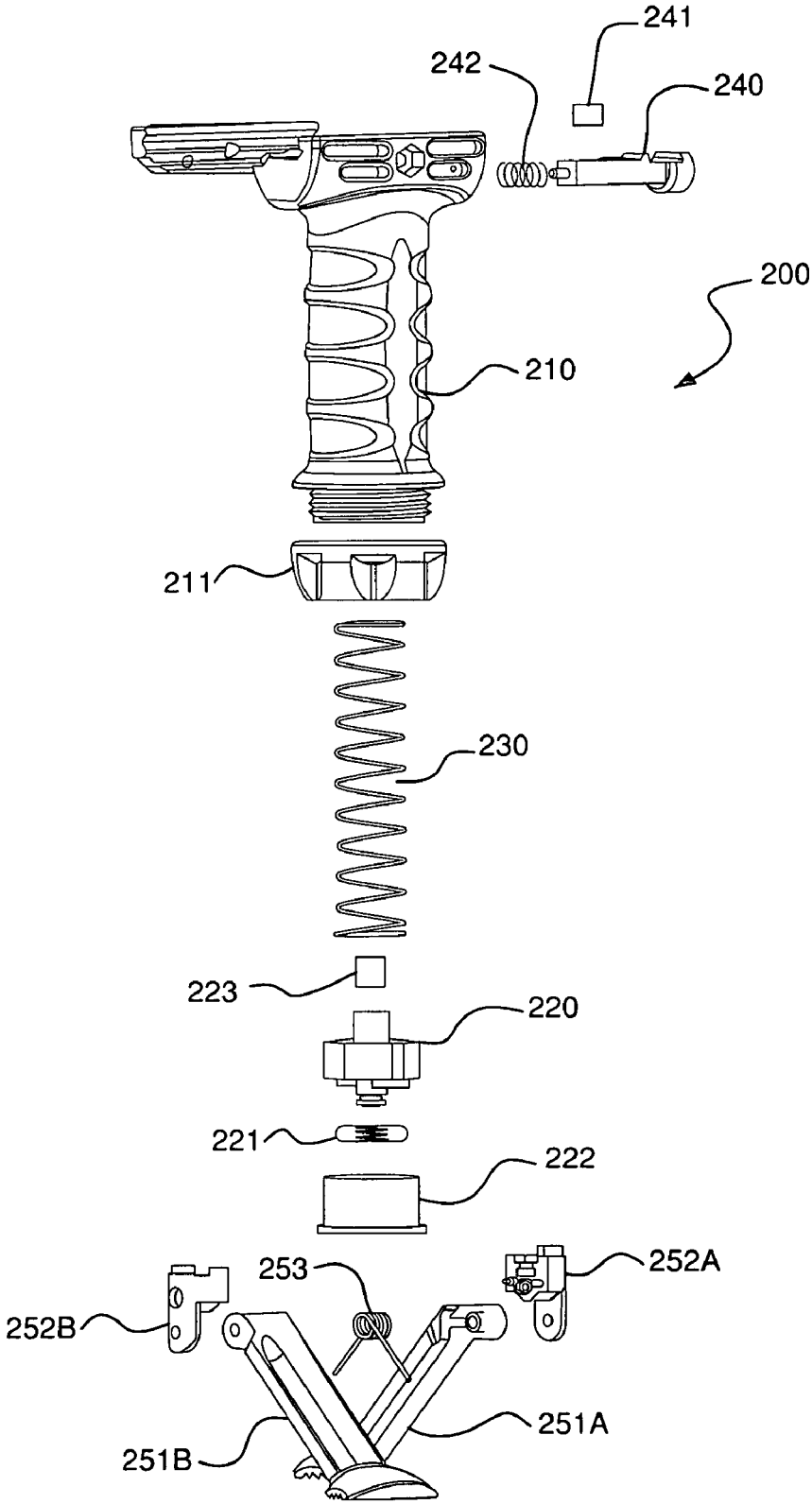
FIG. 2 is an exploded view of a firearm handgrip according to an exemplary embodiment of the invention.

FIG. 2 shows an exploded view of a firearm handgrip 200 with retractable bipod according to an exemplary embodiment of the invention. The handgrip 200 comprises a hollow housing 210 configured to be gripped with the forward hand when it is mounted to a firearm. The housing 210 has a top end defining a horizontal channel and an open bottom end. The handgrip 200 further includes a retractable/extendable bipod (shown in an exploded parts view) having a sliding piston 220 that is located within the housing 210. The piston 220 has a top end and a bottom end. The bipod further includes two legs 251A, 251B that are hingedly connected to mounts 252A, 252B. The mounts are located at the bottom end of the piston 220 to move with the piston 220 within the housing 210. A first torsion spring 253 is positioned between the legs 251A, 251B to cause the legs to expand outwardly when the legs are released from within the housing 210. The bipod further comprises a tracking mechanism described further below providing rapid readjustment of the bipod legs. The tracking mechanism includes a horizontally-positioned second torsion spring 221. The second torsion spring 221 has a first end connected to the legs 251A, 251B and a second end connected to the bottom end of the piston 220.

The deployment of the bipod legs out of the housing is achieved by a compression spring 230 positioned between the top end of the housing 210 and the top end of the piston 220. The handgrip 200 also includes a locking assembly for holding the bipod in an up and stored position against the force of the compression spring 230. The locking assembly includes upper and lower members 241, 223 adapted to interact with each other to hold the bipod in a stored position. According to a presently preferred embodiment, the upper and lower members 241, 223 are magnet pieces adapted to attract each other when they are in substantial alignment with sufficient force to overpower the static force of compressed spring 230. The upper magnet piece 241 is carried by a ram 240 of the locking assembly located at the upper end of housing 210. The lower magnet piece 223 is carried by the piston 220. When they are aligned, the upper and lower magnet pieces 241, 242 hold the bipod in a stored position. The ram 240 of the locking assembly is adapted to slide within a horizontal channel of housing 210 to a release position in which the magnet pieces 241, 223 are misaligned to reduce the magnetic attraction and allow the compression spring to deploy the bipod.

When the deployed bipod is placed on a support surface, the handgrip 200 enables panning of the firearm horizontally around the bipod. A horizontal panning motion of the firearm with respect to an established position of the bipod legs on the support surface will generate an opposing torsional force in the second torsion spring 221. Maintaining the firearm in the panned position will require holding against that opposing force. However, the tracking mechanism is configured so that by lifting the firearm so that the weight is off of the bipod legs 251A, 251B, the torsion spring 231 will return to its neutral position tracking the new horizontal angle of the firearm such that the legs 251A, 251B are aligned under and substantially perpendicular to the bore of the firearm without spring tension.

Figure 3:
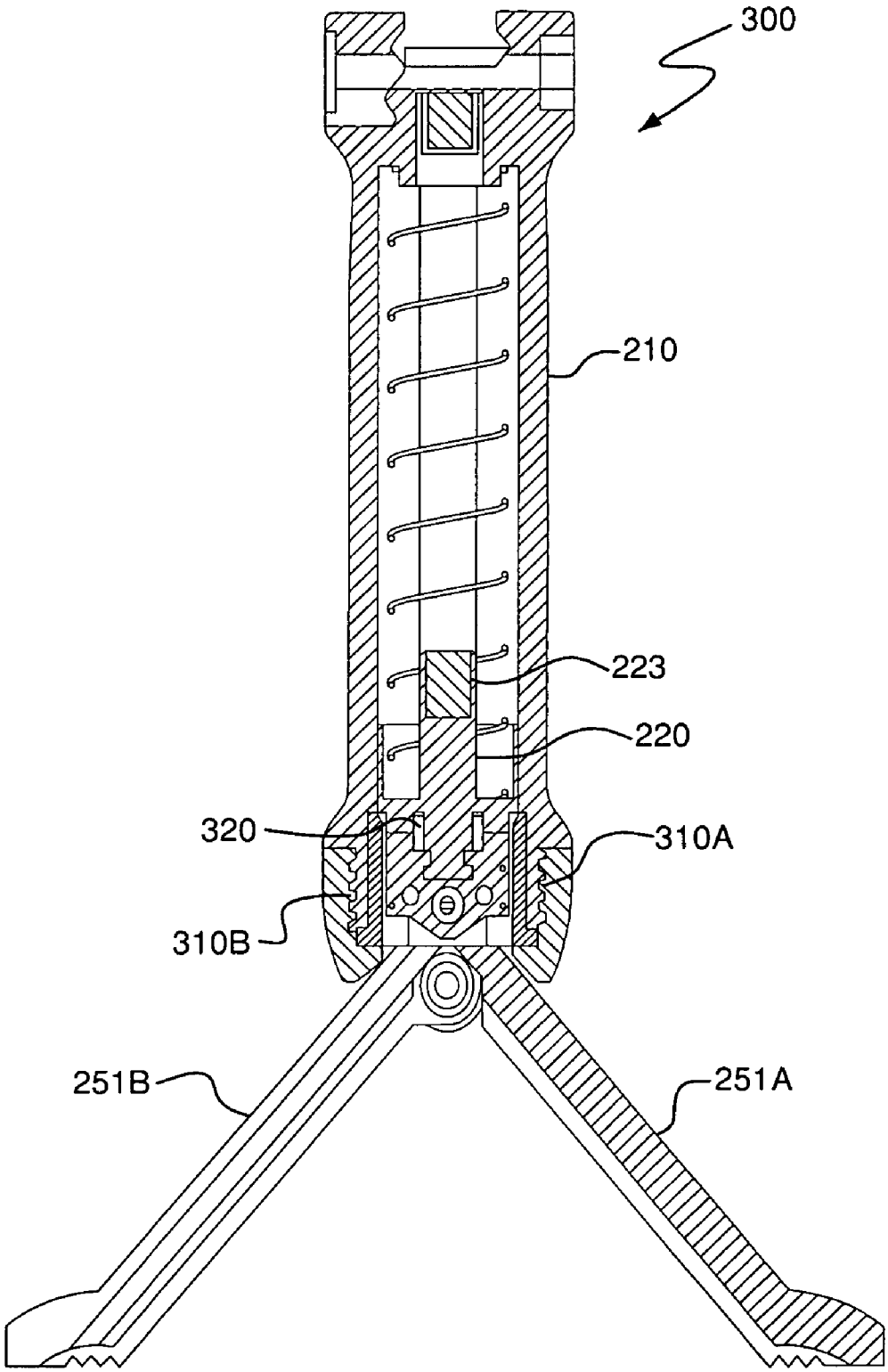
FIG. 3 is a cross-sectional view of a firearm handgrip according to an exemplary embodiment of the invention showing the bipod of the firearm handgrip in a deployed position.

FIG. 3 shows a cross-sectional view of a firearm handgrip 300 according to an exemplary embodiment of the invention showing the bipod in a deployed position. The horizontal tracking mechanism is depicted in detail. The piston 220 is pushed by the compression spring 230 to the bottom end of the housing 210. The horizontal torsion spring 320 is connected at one end to the bottom end of the piston 220 and at the opposite end to the legs 251A, 251B. Threads 310A, 310B may be included inside the housing 210 at the bottom end of the housing to serve as outline for panning movements. As discussed above with FIG. 2, a twisting force is generated in the horizontal torsion spring 320 of the tracking mechanism during panning movements so that upon lifting of the firearm from the support surface, the legs 251A, 251B of the deployed bipod will automatically readjust their position with respect to the firearm such that the plane containing the bipod legs is aligned substantially perpendicular to the firearm.

Figure 4A:
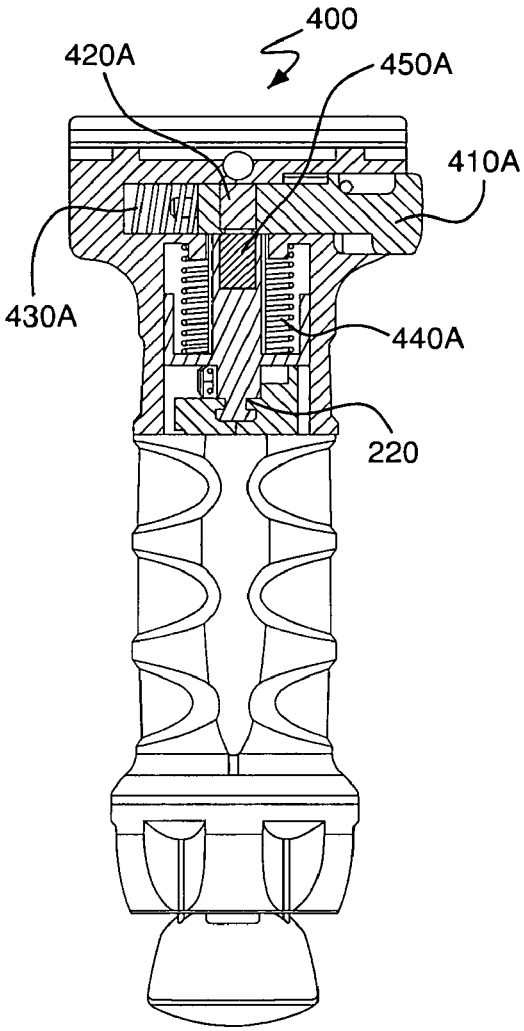
FIGS. 4A, 4B and 4C are cross-sectional views of a firearm handgrip according to an exemplary embodiment of the invention.
Figure 4B:
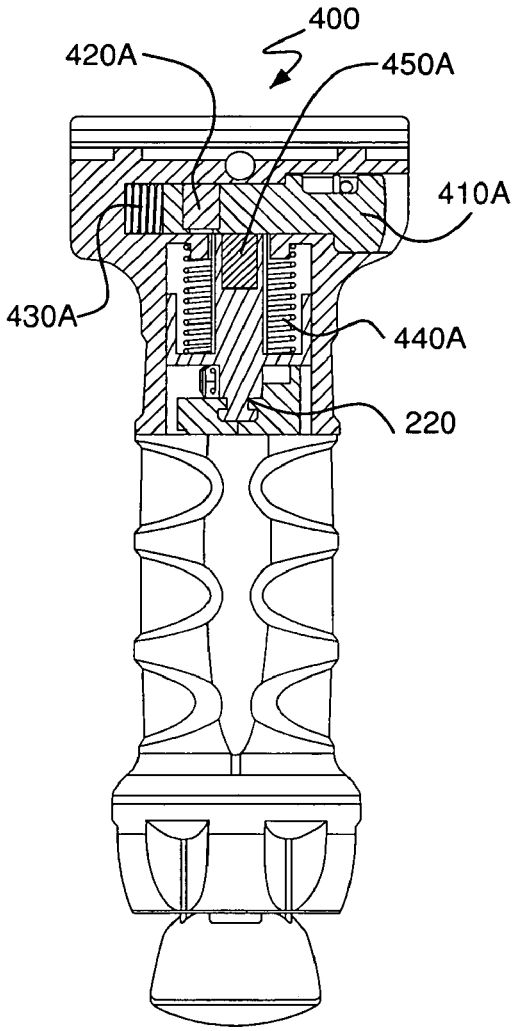
Figure 4C:
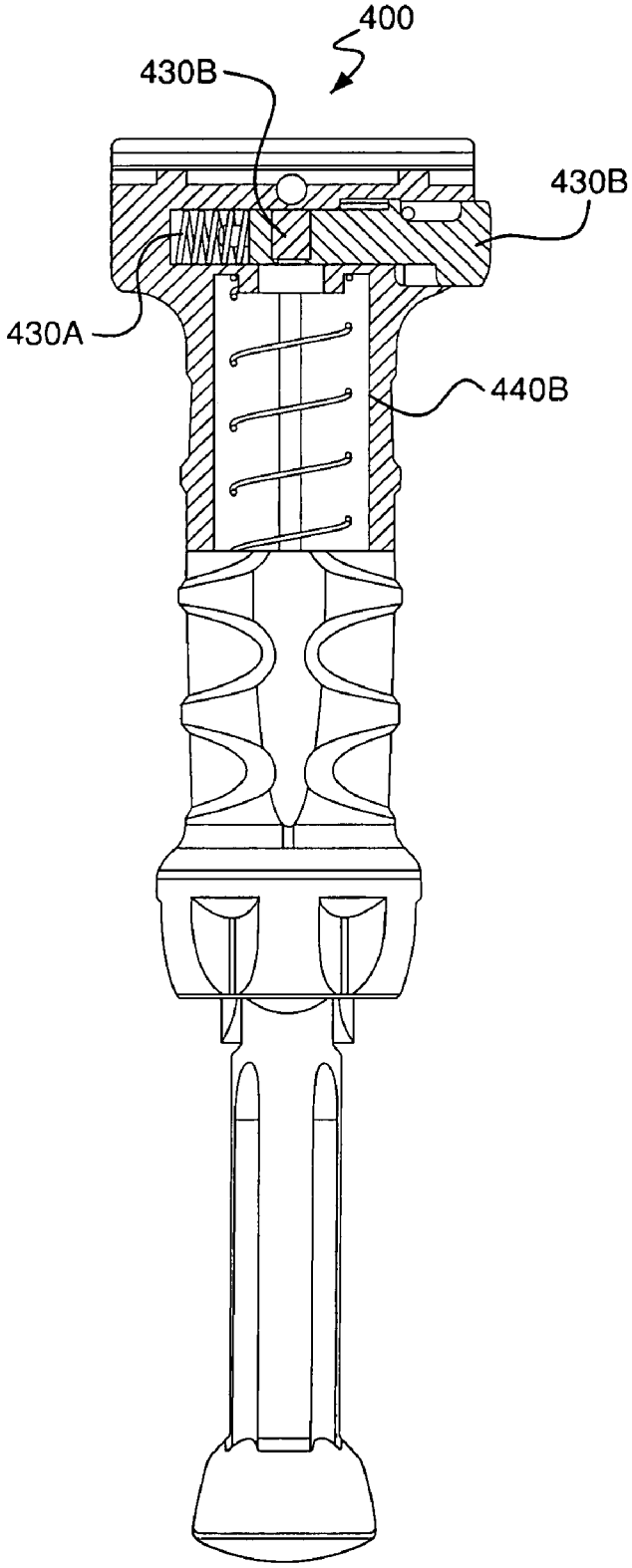

FIGS. 4A, 4B and 4C are cross-sectional views showing a firearm handgrip 400 according to an exemplary embodiment of the invention illustrating the operation of a locking assembly in detail. In FIG. 4A, the bipod of the firearm handgrip 400 is illustrated in a retracted and stored position. When the bipod is in the stored position, the main compression spring 440A is compressed in the space between the top of piston 220 and the housing. The locking assembly of firearm handgrip 400 includes upper and lower locking members 420A, 450A adapted to interact with each to hold the bipod of the firearm handgrip 400 in the stored position against the force of compression spring 440A. According to a presently preferred embodiment, the upper and lower members 420A, 450A are magnet pieces adapted to attract each other with sufficient force when substantially aligned to overpower the compression spring 440A.

The locking assembly also includes a release mechanism having a ram 410A slidingly received within a horizontal channel defined at the top of the housing for movement between first and second positions. The ram 410A is normally biased by a ram compression spring 430A towards the locked, outward position as shown in FIG. 4A. The upper magnet piece 420A is carried by the ram 410A and the lower magnet piece 450A is located in a fixed position on an upper end of the piston 220. This arrangement provides for substantial alignment between the magnet pieces 420A, 450A in close proximity when the bipod is in the stored position and the ram 410A is in the locked first ram position. The attractive force between the magnet pieces 420A, 450A under these conditions is sufficient to overpower the expansive force of the first compression spring 440A.

Referring to FIG. 4B, the release mechanism of firearm handgrip 400 has been actuated (e.g., through the application of a pressing force by a user) to move the ram 410A from the locked, outward ram position to the release, inward ram position. The lateral movement of the ram 410A moves the magnet piece 420A out of alignment with the magnet piece 450A. The misalignment between the pieces 420A, 450A substantially diminishes the attractive force between the magnet pieces. The reduced magnetic attraction under these conditions is less than the expansion force of the first compression spring 440A such that spring 440A is released to expand and drive the bipod downwardly to the deployed condition.

As shown in FIG. 4C, the biasing force of the ram spring 430A returns the ram 410A outwardly to the first ram position when the user removes the actuating force (e.g., takes thumb pressure off of the ram). The return of the ram 410A repositions the upper magnet piece 420A for alignment with the lower magnet piece when the bipod is returned to the stored position of FIG. 4A. The magnetic feature associated with the locking assembly of firearm handgrip 400 is more reliable than a mechanical mechanism, as there is practically no contact between the bipod deployment spring 440A and the ram 410A.

In the above description, an embodiment is an example or implementation of the invention. The various appearances of "one embodiment," "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

It is understood that the phraseology and terminology employed herein is not to be construed as limiting and are for descriptive purpose only.

The principles and uses of the teachings of the present invention may be better understood with reference to the accompanying description, figures and examples.

It is to be understood that the details set forth herein do not construe a limitation to an application of the invention.

Furthermore, it is to be understood that the invention can be carried out or practiced in various ways and that the invention can be implemented in embodiments other than the ones outlined in the description below.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The descriptions, examples, methods and materials presented in the claims and the specification are not to be construed as limiting but rather as illustrative only.

Meanings of technical and scientific terms used herein are to be commonly understood as by one of ordinary skill in the art to which the invention belongs, unless otherwise defined.

The present invention can be implemented in the testing or practice with methods and materials equivalent or similar to those described herein.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention.

While the invention has been described with respect to a limited number of embodiments, these should not be construed as limitations on the scope of the invention, but rather as exemplifications of some of the embodiments. Those skilled in the art will envision other possible variations, modifications, and applications that are also within the scope of the invention. Accordingly, the scope of the invention should not be limited by what has thus far been described, but by the appended claims and their legal equivalents. Therefore, it is to be understood that alternatives, modifications, and variations of the present invention are to be construed as being within the scope and spirit of the appended claims.

What is claimed is:

1. A firearm handgrip with a retractable and extendable bipod, said handgrip comprising:

a hollow housing adapted to be a handgrip that is mountable to a firearm; and a bipod that is retractable into and extendable from the grip housing, the bipod enabling horizontal panning of the firearm relative to the bipod, and further comprising a torsion spring that opposes the panning motion and enables quick realignment of the bipod legs to the firearm when the firearm is lifted;

a compression spring for forcing deployment of the bipod out of the housing; and a release mechanism for releasing the spring and deploying the bipod, wherein the release mechanism includes upper and lower magnetic members arranged to attract each with sufficient force when substantially aligned to overpower an expansive force of the deployment compression spring.

2. A handgrip as in claim 1, wherein the bipod includes a vertically sliding piston located within the housing under the force of the compression spring, and the release mechanism includes a ram located within a horizontal channel defined adjacent a top end of the housing, wherein the upper and lower magnet pieces are respectively carried by the ram and the piston, the ram moveable between a first position in which the upper and lower magnets are substantially aligned with each other and a second position in which the upper and lower magnets are misaligned, the misalignment of the magnet pieces sufficiently reducing the attraction force between the magnet pieces to allow the compression spring to move the bipod to the deployed position.

* * * * *